United States Patent [19]

Maierson

[11] 4,337,968

[45] Jul. 6, 1982

[54] SENSITIZED RECORD SHEET

[75] Inventor: Theodore Maierson, Dayton, Ohio

[73] Assignee: The Standard Register Company, Dayton, Ohio

[21] Appl. No.: 200,450

[22] Filed: Oct. 24, 1980

Related U.S. Application Data

[63] Continuation-in-part of Ser. No. 961,497, Nov. 17, 1978, abandoned.

[51] Int. Cl.[3] ..... B41M 5/22

[52] U.S. Cl. ..... 282/27.5; 427/150; 427/151; 427/261; 428/195; 428/211; 428/304.4; 428/320.2; 428/331; 428/341; 428/342; 428/537; 428/914

[58] Field of Search ..... 428/531, 452, 149, 914, 428/195, 211, 309.4, 320.2, 331, 341, 342, 537; 106/21; 282/27.5; 260/19 R, 19 N; 427/150, 151, 261

[56] References Cited

U.S. PATENT DOCUMENTS

| | | | |
|---|---|---|---|
| 3,466,184 | 9/1969 | Bowler et al. | 428/288 |
| 3,466,185 | 9/1969 | Taylor | 427/150 |
| 3,516,845 | 6/1970 | Brochett et al. | 428/452 |
| 3,672,935 | 6/1972 | Miller et al. | 428/531 |
| 3,723,156 | 3/1973 | Brockett et al. | 428/531 |
| 3,732,120 | 5/1973 | Brockett et al. | 428/320.4 |
| 3,932,695 | 1/1976 | Davis et al. | 428/531 |
| 4,005,237 | 1/1977 | Panken | 282/27.5 |
| 4,060,262 | 11/1977 | Maierson | 282/27.5 |
| 4,087,284 | 5/1978 | Golden et al. | 106/21 |
| 4,089,547 | 5/1978 | Brynko | 427/151 |
| 4,147,830 | 4/1979 | Kato et al. | 427/151 |
| 4,154,462 | 5/1979 | Golden et al. | 282/27.5 |

OTHER PUBLICATIONS

Schue; G. R., "Functions and Parometers of Fumed Silica in Paint Systems", *American Paint Journal*, 7/8/68.

Bode; R. et al., "Basis and Applications of a Silica Produced by Flame-Hydrolysis", *Paint, Oil and Color Journal*, Sep. 6, 1968, pp. 1-7.

"Sunthene Series", from catalog of Sun Petroleum Products Co., P. O. Box 7430, Phila., Pa., 19101 (undated).

*Primary Examiner*—John D. Smith
*Assistant Examiner*—Janyce A. Bell
*Attorney, Agent, or Firm*—Jacox & Meckstroth

[57] ABSTRACT

A very thin film of acidic color developing material which reacts with a dye precursor to form a color upon contact therewith is obtained in a substantially spongy capillary-like film firmly adhered to the paper substrate without diffusing thereinto in accordance with the present invention. The film contains a phenolic resin, and amorphous lipohilic silica, preferably pyrogenic hydrophobic silica, and a fatty alcohol, preferably cetyl alcohol. The composition further preferably includes a nonvolatile solvent. This composition not only provides excellent color-forming ability with a very thin film which adheres firmly to the paper, but may be applied to the paper with a standard printing press.

19 Claims, No Drawings

SENSITIZED RECORD SHEET

CROSS REFERENCE TO RELATED APPLICATIONS

The present application is a continuation-in-part of application Ser. No. 961,497, filed Nov. 17, 1978, now abandoned, the entire contents of which are hereby incorporated by reference.

FIELD OF THE INVENTION

The present invention relates to record material sheets bearing a coating which contains a phenolic resin which acts as a co-reactant for colorless chromogenic dye precursor material to develop a useful color thereon, and more particularly to such record sheets which provide excellent imaging with smaller amounts of phenolic resin. The present invention also relates to the ink composition which is applied to the paper to make such record material sheets and the method of application of such ink composition.

BACKGROUND OF THE INVENTION

In the manufacture of pressure-sensitive recording papers, better known as carbonless copy papers, a layer of pressure-rupturable microcapsules containing a solution of colorless dyestuff precursor is normally coated on the back side of the front sheet of paper of a carbonless copy paper set. This coated backside is known as the CB coating. In order to develop an image or copy, the CB coating must be mated with a paper containing a coating of suitable color developer, also known as dyestuff acceptor, on its front. This coated front color developer coating is called the CF coating. The color developer is a material, usually acidic, capable of forming the color of the dyestuff by reaction with the dyestuff precursor. Marking of the pressure-sensitive recording papers is effected by rupturing the capsules in the CB coating by means of pressure to cause the dyestuff precursor solution to be exuded onto the front of the mated sheet below it. The colorless or slightly colored dyestuff, or dyestuff precursor, then reacts with the color developer in the areas at which pressure was applied, thereby affecting the colored marking. Such mechanism or the producing technique of pressure-sensitive recording papers is well known.

Among the well known color developers used on CF record sheets are phenolic-type resins, such as acetylated phenolic resins, salicylic acid modified phenolics and, particularly, novolac type phenolic resins.

Among the well known basic, reactive, colorless, chromogenic dye-precursors useful for developing colored marks when and where applied to a receiving sheet coated with such color developers are Crystal Violet Lactone (CVL), the p-toluenesulfinate salt of Michler's Hydrol or 4,4'bis(diethylamino)benzhydrol, Benzoyl Leuco Methylene Blue (BLMB), Indolyl Red, Malachite Green Lactone, 8'-methoxybenzoindoline spiropyran, Rhodamine Lactone, and mixtures thereof.

Acid sensitized record receiving sheets have previously been prepared by application of an aqueous slurry of finely ground resin to a paper substrate, as is disclosed, for example, in U.S. Pat. No. 3,672,935. It is also known to apply the resin to the substrate paper sheet as a solution in a volatile organic solvent which evaporates completely after application to leave a thin film of solid resin on the sheet. The latter method is taught in U.S. Pat. Nos. 3,466,184 and 3,466,185. The consistency of these solid solutions and the necessarily volatile solvents used therein give rise to printing problems, causing swelling of rubber plates and rolls. Furthermore they have high energy requirements and environmental contamination problems. The above discussed aqueous slurry application has high energy requirements in grinding the resin and in drying the applied slurry. Such slurries are also not adaptable to printing techniques. Very often, the film of phenolic resin which has been applied to the paper does not adhere firmly to the paper which can cause dusting and offsetting during printing operations.

One previous solution to the problem of standard printing operation adaptability is illustrated in U.S. Pat. No. 4,060,262. The present invention, by the same inventor, is essentially an improvement over said patent.

SUMMARY OF THE INVENTION

Accordingly, it is an object of the present invention to eliminate the deficiencies of the prior art, such as those set forth hereinabove.

It is a further object of the present invention to provide an improvement in the ink used for printing CF coatings in carbonless copy paper sets.

It is another object of the present invention to provide an improved record sheet coated with color developer.

It is yet another object of the present invention to provide a record sheet having a very thin film of color developer which still has excellent imaging and image retention properties.

It is still a further object of the present invention to provide a record sheet having a very thin film of color developer which has properties which are superior to record sheets having larger amounts of resin deposited by prior art processes.

It is yet a further object of the present invention to provide a record sheet having a thin film of color developer having excellent adhesion, substantially eliminating dusting and minimizing offsetting.

It is still another object of the present invention to provide a color developer composition which can be applied to paper using standard unmodified printing presses without affecting any of the rollers used on conventional presses therefore being equally adaptive to both selective and general coating.

It is still another object of the present invention to provide an ink composition containing color developer which can be applied on conventional printing presses at high speeds in excess of 1,000 ft./min. without objectionable misting or the requirement of special venting.

It is yet another object of the present invention to provide a method of applying phenolic-resin coatings on paper by standard printing processes.

These and other objects of the present invention are obtained by means of the present invention in which a very thin film having a substantially spongy nature is firmly adhered to the paper without diffusing thereinto. The three critical ingredients of the film in order to obtain a film with the appropriate properties are a phenolic resin, amorphous lipophilic silica and a fatty alcohol, particularly cetyl alcohol.

DETAILED DESCRIPTION OF PREFERRED EMBODIMENTS

The outstanding properties of the present invention occur because of the spongy type porous structure of the film which is obtained by use of the composition of the present invention. The porous structure of the film serves as a capillary type attractive film which helps to absorb and hold the color forming reactants and solvent, and thus provides a greater color producing ability with a smaller amount of reactants. This film is obtained when using a composition comprising a phenolic resin, a fatty alcohol such as cetyl alcohol, amorphous lipophilic silica, and a solvent. Other additives may also be present.

Any type of phenolic-type resin which is organic solvent soluble and serves as an acidic image former when in combination with a dye precursor may be used in accordance with the present invention. These include acetylated phenolic resins, salicylic acid modified phenolics and, particularly, novolac type phenolic resins.

It is known that with phenolic resin type acid reactive components it is very difficult to obtain a gel because of the fact that this component is so highly aromatic in nature. In view of this highly aromatic nature, it is difficult to obtain a gel structure which holds and retains the product and prevents diffusion into the paper. This problem is solved by means of the other components of the composition of the present invention.

The preferred phenolic resin for use in the present invention is a phenol formaldehyde novolac resin. Either what is termed normal novolac resins or zinc reacted novolac resins can be used. Resins reacted with other appropriate cations to enhance reactivity may also be used. Examples of zinc reacted novolac resins and other metal cations which can be used to enhance the reactivity of novolac resins are disclosed, for example, in U.S. Pat. No. 3,732,120. Rather than being zinc-reacted, the novolac resin may be present with a separate zinc salt, as disclosed in U.S. Pat. No. 3,723,156.

Another known problem with phenolic resins is the fact that they are particularly tacky and therefore create great problems in their use on letterpress-type printing processes at the required concentration levels. This is another of the problems which is solved by the present invention. The other components of the present composition serve to detackify the phenolic resins and permit use of the compositions on standard printing presses.

The second critical component of the present composition is a fatty alcohol, preferably cetyl alcohol which is a $C_{16}$ saturated alcohol. This component has a dual function. First, it serves as an adjunct to the structure in order to get the spongy film which is important to the present invention. The spongy structure of the film which is obtained is a very significant feature of the present invention because the porous structure of the film serves as a capillary type attractive film which helps to absorb and hold the color forming reactants and solvent and thus provide a greater color producing ability with a smaller amount of reactants. The second function of the fatty alcohol is to serve as an internal lubricant in order to reduce the tackiness of the remaining components of the ink, particularly of the phenolic resin. Thus, it serves not only to obtain the particularly novel film which is involved but also for the secondary purpose of making this particular ink not only a better product when on the paper but also a better product because it is easier to apply to the paper.

While cetyl alcohol is the most preferred fatty alcohol, it is possible to use other fatty alcohols if variation of certain ancillary properties due to such substitution are acceptable. For example, it is known that stearyl alcohol will provide similar advantages with respect to acting as an adjunct to the structure in order to get the spongy film and will serve as an internal lubricant to reduce tackiness. However, stearyl alcohol has the disadvantage of affecting ultraviolet stability of the formed image. Stearyl alcohol substantially affects the image forming potential as well as the image stability of the ink. Nevertheless, for some applications this might not be objectionable.

While solid fatty alcohols, such as cety alcohol, are preferred, it is possible that liquid fatty alcohols could be used although it is expected that liquids would give poorer diffusibility. In other words, the spongy structure of the film would not be the same with the use of a liquid fatty alcohol and the capillary action would be different thus causing a difference in the image definition. Furthermore, the more liquid the film, the more likely under elevated temperature conditions that the film will become diffused into the paper thus decreasing the image forming potential as well as the image retention at elevated temperature. Again, however, this may not be a problem in particular applications, such as where denser paper structures are to be used, and in such case liquid fatty alcohols would also be usable.

Other fatty alcohols such as saturated or unsaturated fatty alcohols having even numbers of carbon atoms between 10 and 22, as, for example, oleyl alcohol, myristyl alcohol, lauryl alcohol, and palmitoleyl alcohol are also usable under certain circumstances. However, the product which gives the best all around results is cetyl alcohol.

The third critical ingredient is the silica. This compound actually is a structural adjunct in the composition and is an active ingredient as it chemically forms a skeletal structure in the system. It must be lipophilic in order to be mutually compatible with all of the components in the system. It must also be amorphous and have a stable size not exceeding 50 millimicrons.

The preferred silica is pyrogenic silica. Pyrogenic hydrophilic silicas exist which are lipophilic to some extent and it is possible to use such substances, as, for example, when a polar solvent is used. In general, however, polar solvents, such as glycols and diacetone alcohol, have a deteriorative effect on imageability. Furthermore, a much larger amount of hydrophilic silica must be used in order to compound it into the system.

The most preferred product is a pyrogenic hydrophobic silica.

It is the combined use of the pyrogenic lipophilic silica with the fatty alcohol, preferably cetyl alcohol, which achieves the structural formation of the present invention which is critical to the results. Specific examples of silicas usable in the present invention are those commercially known as Aerosil R 972, manufactured by Degussa or Tullanox 500, manufactured by Tolco, Inc. The former is preferred.

A solvent must also be present in the composition in order to dissolve the phenolic resin and the fatty alcohol. Theoretically, any solvent can be used in which the phenolic resin and the fatty alcohol are soluble, as long as it does not unduly interfere with the dye-resin reaction. Even volatile solvents can be used to lay down a film which will have the properties which are essential to the present invention. However, the preferred solvents are those which are substantially non-evaporative, i.e., having a boiling point above 175° C., preferably 275° C. Using such a non-volatile solvent improves the characteristics of the coated film because there will be a residue of solvent in the solidified gel structure of the spongy film. This high boiling point solvent, as retained in the deposited film, tends to act as a plasticizer and give flexibility to the deposited film, preventing excess dusting at a future time. Having the solvent in small quantities in the deposited film acts in a way to attract the lipophilic components normally found in conventional CB coated systems. Thus, at the instant of impact, the liquid oranophilic nature of the CB dye system is more readily attracted into the slightly wetted highly organophilic surface.

Eligible preferred plasticizing solvent which are compatible with the other components of the formulation and with the chromogenic dye-precursor materials, which are compatible with printing press elements, including rubber plates and rolls, and which show the proper tendency to evaporate in part, include a mixture of alkyl and aromatic hydrocarbons, alkyl esters, aromatic acids, and aryl ethers. Particularly useful is a mixture of monoisopropyl biphenyl and diisopropyl biphenyl, preferably in about a 65:35 percent weight ratio; a similar ratio mixture of monoisopropyl naphthalene and diisopropylnaphthalene, mineral seal oil, as well as mixtures selected from the following: butyl benzoate, methyl isopropyl biphenyl, biphenyl oxide, dimethyl phthalate and benzyl benzoate. Preferred is mineral seal oil, a commercially available hydrocarbon solvent known as Mentor 28 solvent which is likewise a mixture of petroleum fractions containing 25–60% paraffins, 25–60% naphthenics, and 5–20% aromatics (percents by volume). The mineral seal oil may also contain a minor amount (0.5 to 2% by volume) of olefinics. Commercial mineral seal oils have a boiling range of about 260° to 370° C. In use about 50% of the applied mineral seal oil will evaporate from the paper substrate surface, leaving the residue to serve as a film plasticizer and chromogenic reaction solvent.

As disclosed hereinabove, it is also possible to use volatile solvents, such as toluene, xylene, benzene, cyclohexane, hexane, heptane, diethylbenzene, butyl alcohol and ethyl acetate. However, most of these in practice would not be used as they would ruin the rubber rolls of the printing press or would be environmentally offensive.

Whatever solvent is used, it should be present in amounts sufficient to dissolve the phenolic resin and the fatty alcohol. Beyond this, the specific amount of solvent will depend on the particular properties of the composition desirable for use on the printing press, or the particular properties of the obtained film which are desired, all within the confines of the present invention.

Besides the phenolic resin, fatty alcohol, amorphous lipophilic silica and solvent, all of which are necessary, a number of optional additives may also be present to improve the composition or the final film. For example, as a performance additive, there may be added an extremely low volatility oil which will be certain to remain in the film even if the conditions are such as to cause evaporation of the solvent. Preferably, such an oil would have a volatility of no more than 7% weight loss when measured over a 22 hour period at 225° F. Naphthenic oils are exemplary such as Sunthene 410, a product of Sun Petroleum Products Co.

Another additive which improves the properties of the obtained film is polyethylene. Granular polyethylene dissolves in the system at elevated temperatures and provides mechanical rigidity to the structure and serves to prevent syneresis. The preferred polyethylene to be used is oxidized polyethylene because of its imagibility and image stability properties. It is very difficult to find a polymeric additive which will have suitable imagibility and image stability properties in view of the fact that most polymers are either non-compatible with the chemistry of image formation, or they affect the stability of storage, that is, they promote syneretic separation. The preferred polyethylene product for use in the present invention is produced by Allied Chemical Company under the name AC Polyethylene 655.

As stated hereinabove, the color-producing functionality of the phenolic resin is greatly improved when it is present either in conjunction with a zinc salt or in a form which is actually reacted with a zinc compound in order to produce a zincated resin as, for example, in U.S. Pat. No. 3,732,120. While the term zinc is being used, because this is the preferred cation, other metal cations may also be used, such as cadmium (III), zirconium (II), vanadium (II), manganese (II), calcium (II), nickel (II), cobalt (II), strontium (II), aluminum (III), copper (III), and tin (II).

When a metal salt is used as an additive along with the phenolic resin, it is important that it be a zinc salt which is soluble in the system. Liquid zinc salts which are soluble in the system are preferable to solid zinc salts, such as zinc abietate, because the liquid salt will also provide performance characteristics for the ink, such as reducing tack, which are desirable when using letterpress printing, therefore improving press performance. Furthermore, they remain liquid on the paper to contribute to the plasticity of the resin film and promote ready contact of the color-producing reagents. Zinc abietate is operable as far as its color producing functionality, but adds no appreciable properties with respect to improving press performance. Zinc salts which are not organic solvent soluble, such as zinc acetyl acetonate, should not be used as they cannot be compounded into the system. The preferred compounds are liquid zinc alkyl-carboxylate salts, preferable zinc octoate. Also useful is zinc neodecanoate.

It should be understood that the present invention is not meant to exclude other additives for the purpose of further modifying the physical properties of the ink or effecting economy, as long as the imaging and image durability properties of the coating and the spongy nature of the coating, are not unduly affected.

When a volatile solvent is used, an amount of solvent sufficient to dissolve both the phenolic resin and the fatty alcohol is used and the remaining ingredients are present in the following ranges:

| | |
|---|---|
| Phenolic resin | 54–95% |
| Fatty alcohol | 2–40% |
| Lipophilic silica | 0.5–6% |

When a non-volatile solvent is used, the following relative proportions of ingredients are contemplated within the ambit of the present invention:

| | Range % | Preferred Range % |
|---|---|---|
| Phenolic Resin | 10–70% | 20–50% |
| Fatty alcohol | 2–20% | 2–15% |
| Lipophilic silica | .5–6% | .5–5% |
| Non-volatile solvent | 18–82% | 35–69.5% |

With respect to the additives, the polyethylene may be added in the range of 1–6% of the total formulation, preferably 2–4%. The plasticizing oil, such as a naphthenic oil, is added in an amount of 5–20%, preferably 5–15%. When a liquid zinc salt is used, it is added in a range of 2–15%, preferably 5–10%. It should be understood, however, that the liquid zinc salt also functions as a plasticizing oil, therefore the combined amount of naphthenic oil and liquid zinc salt should not exceed 20% in the formulation, and preferably should not exceed 15%. When a solid zinc salt is used, such as zinc abietate, it is added in the amount of 5–15% and preferably 7–10%.

The fully stabilized functional coating weight of the coating composition in accordance with the present invention is preferably 0.4–1.4 g/m$^2$, preferably 0.7–1.1 g/m$^2$.

In preparing the formulation, the liquid ingredients are first mixed and then heated to 90°–110° C. Then the solid components are added, preferably in the order: polyethylene, cetyl alcohol, pyrogenic silica, zinc abietate, phenolic resin.

The following examples will better illustrate the invention:

EXAMPLE 1

Ink Formulation.

With heating (90°–110° C.) and stirring the following materials are combined, conveniently in the order shown:

| | Range % | Preferred % |
|---|---|---|
| Mineral seal oil | 25–32 | 29.5 |
| Sunthene 410 | 5–9 | 7 |
| Zinc octoate | 4–8 | 6 |
| AC Polyethylene 655 | 2–4 | 3.5 |
| Aerosil R 972 | 2–4 | 4 |
| Cetyl alcohol | 5–10 | 8 |
| Polytack 100 (zinc abietate) | 5–12 | 8 Novolac |
| HRJ 1216 (zincated novolac resin) | 30–40 | 34 |
| | | 100% |

The ink so produced is ready for use. Novolac HRJ 1216 is available from Schenectady Chemicals, Inc. The preferred non-zincated novolac resin is HRJ 426, also available from the same source.

EXAMPLE 2

CF Record Sheet.

A letterpress printing press was loaded with the ink of example 1 and adjusted to apply the equivalent of 0.15–0.35 (and preferably 0.2–0.3) lbs. of ink per ream of 17×22 inch paper. This proportionate weight of application is used regardless of whether the press is web-fed or sheet-fed. A solvent loss (by evaporation) on the paper of 20–30% sufficient to immobilize the ink to leave it in a plastic state, was observed to have occurred in 1–4 hours. Evaporation and diffusion continue in the roll, but appear to be essentially complete to give a stable product within 48 hours after application. A high speed press, having speeds in excess of 1,000 ft./minute may be used without objectionable misting.

A commercial CB sheet, having a coating of CVL-mono-isopropyl biphenyl droplets in microcapsules thereon, when mated with the sensitized record sheet of this example, gave dark blue to blue-black marks on the sensitized record sheet at points corresponding to positions marked on the upper surface of the CB sheet.

The final results of the present process is substantially superior to all other CF coatings, particularly in view of the fact that only a very thin film is necessary. Despite the fact that a very thin film is used, the properties of the record sheets are actually superior than when larger amounts of resin are deposited by prior art processes. Furthermore, the adhesion of the thin film of the present invention through the paper is extremely good, substantially eliminating dusting and minimizing offsetting. The entire coating remains on the surface of the paper and does not unduly diffuse itself within the fibers, thus leaving the entire reactive body of the coating on the surface of the paper, and yet highly adhesively bonded thereto.

The preferred composition of the present invention is also extremely important in that it can use standard printing presses unmodified without affecting any of the rollers used on conventional presses. Therefore, it can be easily used with conventional presses to place discontinuous portions of CF coatings on portions of the paper in the midst of the regular printing process which is otherwise printing the forms. In other words, it is equally adapted to both selective and general coating. Discontinuous printing with screening effects on the print surface may also be used.

Another desirable property of the composition of the present invention is its functionality at high speeds in excess of 1,000 ft./min. without objectionable misting. Special venting is not required. Water evaporation is not necessary, thus resulting in energy savings, and the dimensional stability of the paper is retained. Furthermore, this is a pumpable system which can be automatically fed to the press; therefore, the entire ink may be formulated and stored before use. No storage limitation conditions have yet been ascertained. Because the tack and the body of the resin are controllable in accordance with the present invention, any type of conventional printing press may be used including letterpress, flexographic gravure, offset, etc.

Although preferred embodiments of the composition coated sheet and process of the present invention has been described, it will be understood that within the purview of this invention various changes may be made in the form, proportion and ingredients and the combination thereof, which generally stated consists in a method and a composition capable of carrying out the object set forth, as disclosed and defined in the appended claims.

What is claimed is:

1. A thin spongy porous color developer film for use in producing a color when in contact with a suitable dye precursor, produced by thinly depositing on a substrate a composition consisting essentially of:

an organic solvent soluble phenolic resin capable of serving as an acidic image former when in combination with a suitable dye precursor, in an amount sufficient to serve as such an image former in the final film;

a lipophilic amorphous silica having a stable size not exceeding 50 millimicrons;

a fatty alcohol capable of serving as an adjunct in combination with said silica to obtain a porous film structure without substantially adversely affecting the color forming reaction or the color so formed, the combined amounts of said fatty alcohol and lipophilic silica being sufficient to form a spongy capillary skeletal structure in the deposited film; and an organic solvent capable of dissolving said phenolic resin and said fatty alcohol and which does not substantially interfere with the color-forming reaction.

2. A film in accordance with claim 1, wherein said phenolic resin is an acetylated phenolic resin, salicylic acid modified phenolic resin or a novolac-type phenolic resin.

3. A film in accordance with claim 1, wherein said phenolic resin is one which has been reacted with or is present in conjunction with a metal cation capable of enhancing the color forming ability of the resin.

4. A film in accordance with claim 3, wherein said cation is zinc.

5. A film in accordance with claim 1, wherein said fatty alcohol is cetyl alcohol.

6. A film in accordance with claim 1 or claim 5, wherein said lipophilic silica is a pyrogenic hydrophobic silica.

7. A film in accordance with claim 1, wherein said solvent is a non-volatile solvent having a boiling point above about 175° C. and present in an amount sufficient to act as a plasticizer when retained in the deposited film.

8. A film in accordance with claim 1, wherein said solvent is mineral seal oil.

9. A film in accordance with claim 1, wherein said composition further includes gelatinous polyethylene in an amount sufficient to provide mechanical rigidity to the deposited film structure without otherwise affecting the spongy nature thereof and which will not substantially affect the color-forming reaction or the color so formed.

10. A film in accordance with claim 9, wherein said polyethylene comprises oxidized polyethylene.

11. A film in accordance with claim 1, wherein said composition further includes a liquid zinc salt, soluble in the system, in an amount sufficient to improve the color forming ability of said phenolic resin and reduce the tack of the composition to improve press performance of the composition.

12. A film in accordance with claim 1, wherein said solvent is a volatile solvent and said phenolic resin, fatty alcohol and lipophilic silica are present in the following relative quantities:

| | |
|---|---|
| phenolic resin | 54–95% |
| fatty alcohol | 2–40% |
| lipophilic silica | 0.5–6% |

13. A film in accordance with claim 7, wherein the relative proportions of components of said composition are:

| | |
|---|---|
| phenolic resin | 10–70% |
| fatty alcohol | 2–20% |
| lipophilic silica | 0.5–6% |
| non-volatile solvent | 18–82% |

14. A film in accordance with claim 13, wherein said proportions are:

| | |
|---|---|
| phenolic resin | 20–50% |
| fatty alcohol | 2–15% |
| lipophilic silica | 0.5–5% |
| non-volatile solvent | 35–69.5% |

15. A film in accordance with claim 1 in a quantity corresponding to 0.4–1.4 g/m$^2$.

16. A film in accordance with claim 1, wherein said composition consists essentially of:

| | |
|---|---|
| non-volatile solvent | 25–32% |
| oil with volatility of no more than 7% weight loss over 22 hour period at 225° F. | 5–9% |
| liquid zinc salt | 4–8% |
| granular oxidized polyethylene | 2–4% |
| pyrogenic hydrophobic silica | 2–4% |
| cetyl alcohol | 5–10% |
| zinc abietate | 5–12% |
| zincated novolac resin | 30–40% |

17. A film in accordance with one of claims 12, 13 or 14 wherein said fatty alcohol is cetyl alcohol and said lipophilic silica is pyrogenic hydrophobic silica.

18. A record sheet comprising a sheet substrate having deposited thereon a thin continuous or discontinuous film in accordance with claim 1.

19. A method for producing a sheet having printed thereon a color developer being capable of producing a color when in contact with a suitable dye precursor, comprising:

printing with a conventional printing press, in a quantity corresponding to 0.4 to 1.4 g/m$^2$, a composition consisting essentially of:

10–70% of a zincated or non-zincated novolac resin;

2–20% of cetyl alcohol;

0.5–6% of pyrogenic hydrophobic silica; and

18–82% of a non-volatile solvent for said novolac resin and said cetyl alcohol.

* * * * *